US010589138B2

(12) United States Patent
Petit

(10) Patent No.: US 10,589,138 B2
(45) Date of Patent: Mar. 17, 2020

(54) ENHANCED FOAM SPRAY PATTERN DEVICE

(71) Applicant: Akron Brass Company, Wooster, OH (US)

(72) Inventor: Kevin Petit, Wooster, OH (US)

(73) Assignee: Akron Brass Company, Wooster, OH (US)

( * ) Notice: Subject to any disclaimer, the term of this patent is extended or adjusted under 35 U.S.C. 154(b) by 476 days.

(21) Appl. No.: 15/133,830

(22) Filed: Apr. 20, 2016

(65) Prior Publication Data

US 2016/0303410 A1 Oct. 20, 2016

Related U.S. Application Data

(60) Provisional application No. 62/149,864, filed on Apr. 20, 2015.

(51) Int. Cl.

| | |
|---|---|
| ***A62C 31/12*** | (2006.01) |
| ***A62C 31/03*** | (2006.01) |
| ***A62C 5/02*** | (2006.01) |
| ***B05B 7/00*** | (2006.01) |

(52) U.S. Cl.

CPC ..... *A62C 31/12* (2013.01); *A62C 5/022* (2013.01); *A62C 31/03* (2013.01); *B05B 7/0031* (2013.01)

(58) Field of Classification Search

CPC ... A62C 5/02–027; A62C 31/03; A62C 31/05; A62C 31/12; B05B 1/16; B05B 1/1627; B05B 1/1663; B05B 7/0018–0068

USPC ..... 169/14, 15; 239/396, 437–441, 456–458, 239/460, 530

See application file for complete search history.

(56) References Cited

U.S. PATENT DOCUMENTS

| | | | | |
|---|---|---|---|---|
| 3,363,842 A * | 1/1968 | Burns | ..... | A62C 31/03 239/441 |
| 4,944,460 A * | 7/1990 | Steingass | ..... | A62C 31/03 169/89 |
| 5,012,979 A | 5/1991 | Williams | | |
| 5,113,945 A | 5/1992 | Cable | | |

(Continued)

OTHER PUBLICATIONS

PCT International Search Report and Written Opinion from International Application No. PCT/US2016/028409, dated Jul. 29, 2016, 14 pages.

(Continued)

*Primary Examiner* — Cody J Lieuwen

(74) *Attorney, Agent, or Firm* — Tucker Ellis LLP; Michael G. Craig

(57) ABSTRACT

One or more techniques and/or systems are disclosed for a foam fluid dispensing device that allows for quick and easy adjustment between a straight stream and dispersed stream. A user can quickly adjust between various stream patterns using a common motion in nozzle operation. An example device can comprise a nozzle comprising a nozzle body and an inlet configured to receive a flow of fluid, with a nozzle stem centrally disposed in the nozzle and fixedly engaged with the nozzle body. The device can also comprise a foam tube configured to receive and dispense at least a portion of the flow of fluid from the nozzle, with a foam tube coupler fixedly engaged with the foam tube. The foam tube coupler can be configured to operably couple with the nozzle stem.

12 Claims, 10 Drawing Sheets

(56) References Cited

U.S. PATENT DOCUMENTS

| | | | | | |
|---|---|---|---|---|---|
| 5,335,734 | A | | 8/1994 | Scott et al. | |
| 5,417,371 | A | * | 5/1995 | Brackett | B05B 7/005 239/391 |
| 5,575,341 | A | * | 11/1996 | Baker | A62C 31/12 169/14 |
| 5,590,719 | A | * | 1/1997 | McLoughlin | A62C 31/03 169/13 |
| 5,848,752 | A | * | 12/1998 | Kolacz | A62C 31/12 239/428.5 |

OTHER PUBLICATIONS

European Patent Office, Extended European Search Report for 16783750.9, date of search Jan. 29, 2019, Munich, 10 pages.

* cited by examiner

ENHANCED FOAM SPRAY PATTERN DEVICE

CROSS-REFERENCE TO RELATED APPLICATIONS

This application claims priority to U.S. Ser. No. 62/149,864, entitled ENHANCED SPRAY PATTERN DEVICE FOR AIR ASPIRATING FIRE FIGHTING FOAM NOZZLES, filed Apr. 20, 2015.

BACKGROUND

Currently, foam dispensing firefighting nozzle systems utilize an attached foam tube, into which the fluid flow is directed. When the user wishes to provide a straight stream of foam, a straight tip is provided. When the user wishes to provide a dispersed pattern of foam, a shaper tube tip is attached. The foam tube is attached at a foam dispensing nozzle outlet using perimeter attaching couplers to hold the tube fixedly with the nozzle.

SUMMARY

This Summary is provided to introduce a selection of concepts in a simplified form that are further described below in the Detailed Description. This Summary is not intended to identify key factors or essential features of the claimed subject matter, nor is it intended to be used to limit the scope of the claimed subject matter.

As provided herein, fluid dispensing system and device that allows for quick and easy adjustment between a straight stream and dispersed stream. That is, a use may be able to merely adjust (e.g., rotate) and actuator on the nozzle portion to switch between a straight stream and dispersed stream of foam. Additional attachments can be mitigated, thereby reducing complexity, weight, and equipment failures.

In one implementation, a device or system for dispensing firefighting fluid can comprise a nozzle comprising a nozzle body and an inlet configured to receive a flow of fluid. Further, a nozzle stem can be centrally disposed in the nozzle and fixedly engaged with the nozzle body. Additionally, the device or system can comprise foam tube that may be configured to receive and dispense at least a portion of the flow of fluid from the nozzle. A foam tube coupler can be fixedly engaged with the foam tube, and can be configured to operably couple with the nozzle stem.

To the accomplishment of the foregoing and related ends, the following description and annexed drawings set forth certain illustrative aspects and implementations. These are indicative of but a few of the various ways in which one or more aspects may be employed. Other aspects, advantages and novel features of the disclosure will become apparent from the following detailed description when considered in conjunction with the annexed drawings.

BRIEF DESCRIPTION OF THE DRAWINGS

What is disclosed herein may take physical form in certain parts and arrangement of parts, and will be described in detail in this specification and illustrated in the accompanying drawings which form a part hereof and wherein.

DETAILED DESCRIPTION

Figure 1:
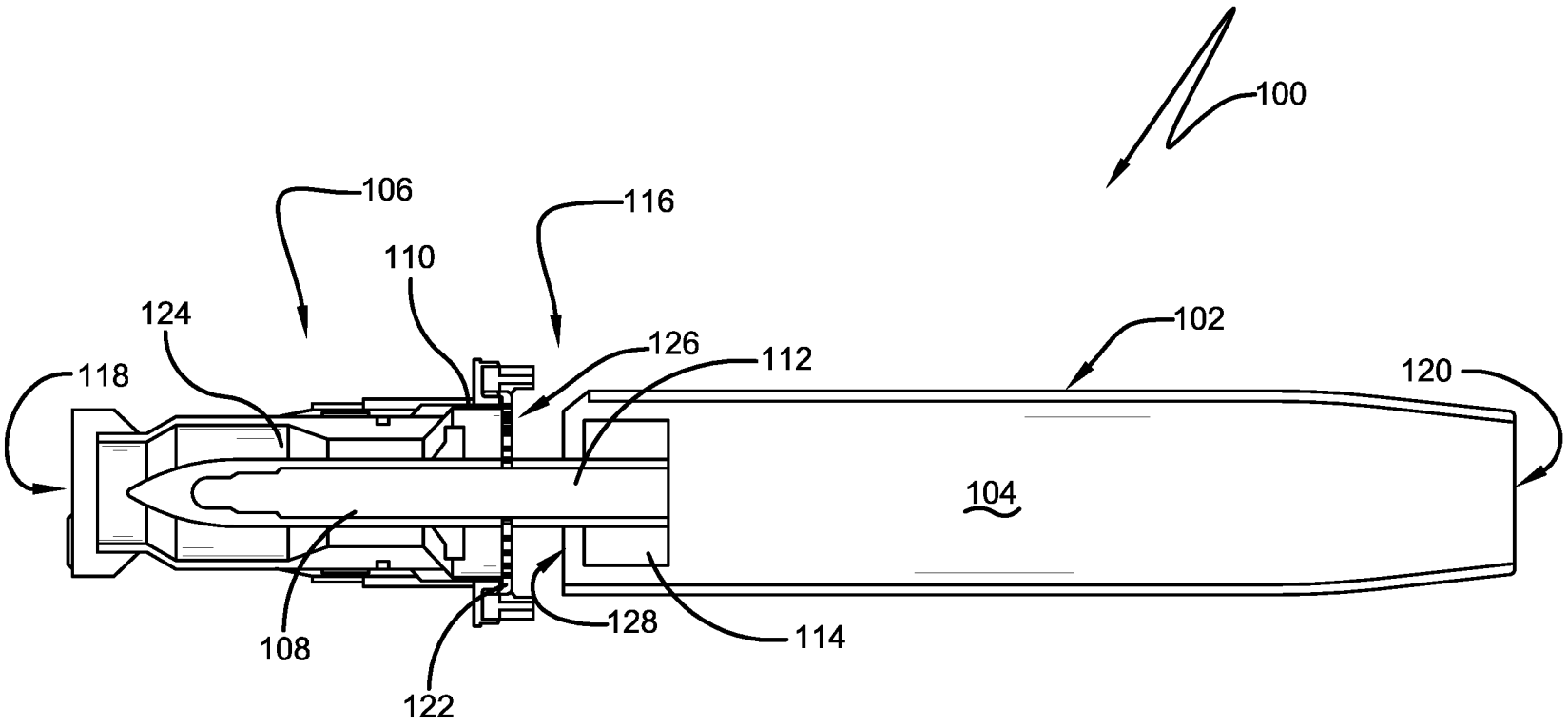
FIG. 1 is a component diagram illustrating an example implementation of an exemplary device for dispensing fluid.

The claimed subject matter is now described with reference to the drawings, wherein like reference numerals are generally used to refer to like elements throughout. In the following description, for purposes of explanation, numerous specific details are set forth in order to provide a thorough understanding of the claimed subject matter. It may be evident, however, that the claimed subject matter may be practiced without these specific details. In other instances, structures and devices may be shown in block diagram form in order to facilitate describing the claimed subject matter.

An apparatus can be devised for use in controlling fluid flow discharge, such as for firefighting operations. For example, different firefighting operations may utilize different types of fluids, depending on the type of fuel, fire, conditions, etc. Sometimes, firefighting operations may switch between different firefighting equipment during the course of a firefighting operation. For example, switching between a foam-based fluids and water-based fluids. Foam-based fluids typically utilize a foam-water solution, into which air is entrained and mixed in a nozzle system, to form a foam fluid discharge from the nozzle system.

A system may be devised that provides for changing the shape of the foam discharge between a straight stream and a cone-shaped or dispersed pattern. The system can comprise a nozzle portion, which is configured to discharge a foam-water mixture in a straight stream or a dispersed (e.g., fog pattern or cone-shaped pattern). A foam tube can be coupled at the outlet end of the nozzle. The foam tube can be configured to receive the straight stream discharge, and to entrain air into the foam-water mixture, resulting a foam-water-air mixture discharge. Further, in the dispersed pattern, the foam-water mixture may be entrained with air using turbine teeth, resulting in a cone-shaped pattern that substantially bypasses the foam tube.

Figure 2:
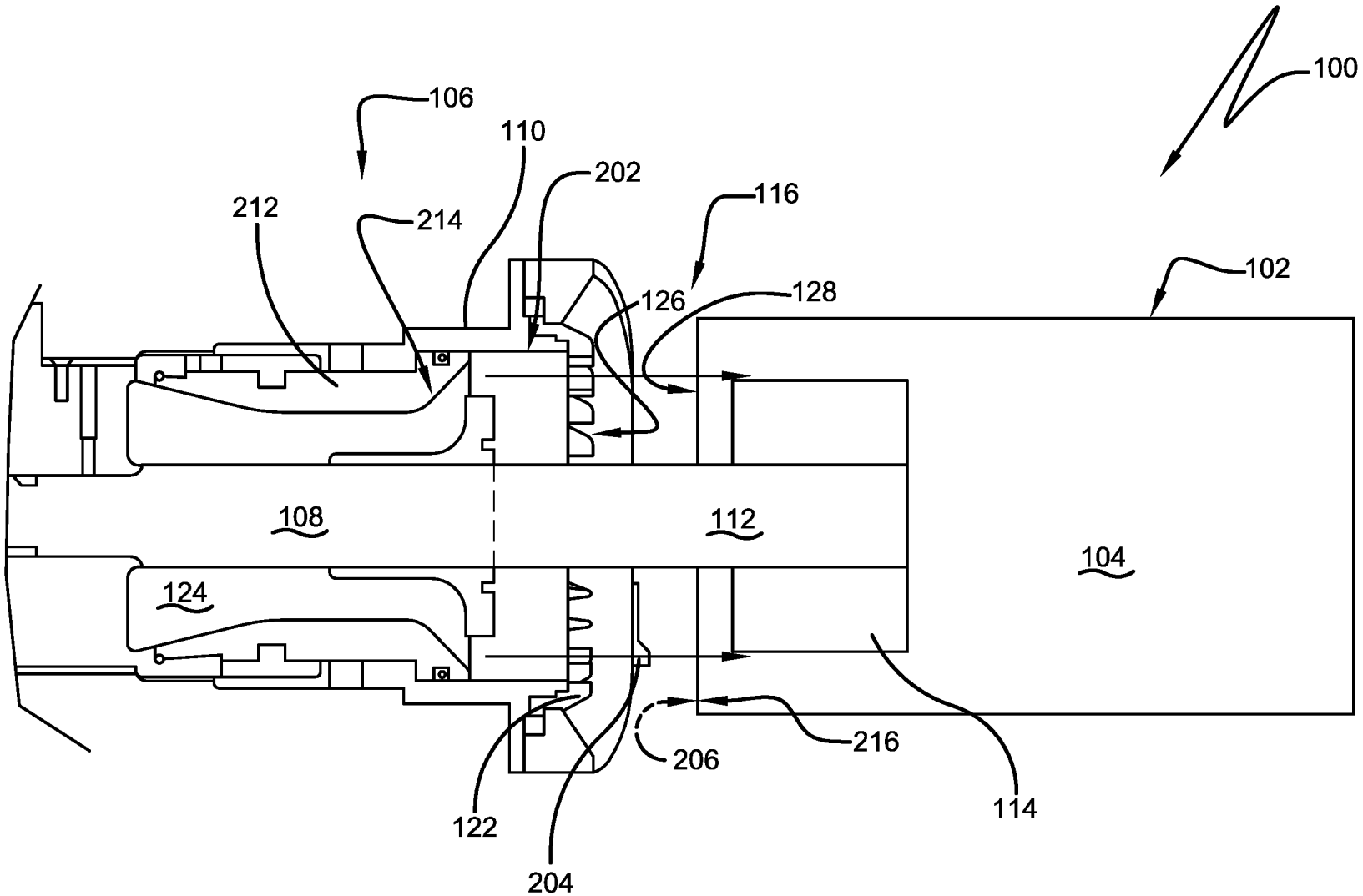
FIG. 2 is a component diagram illustrating an example implementation of one or more portions of one or more components described herein.
Figure 3:
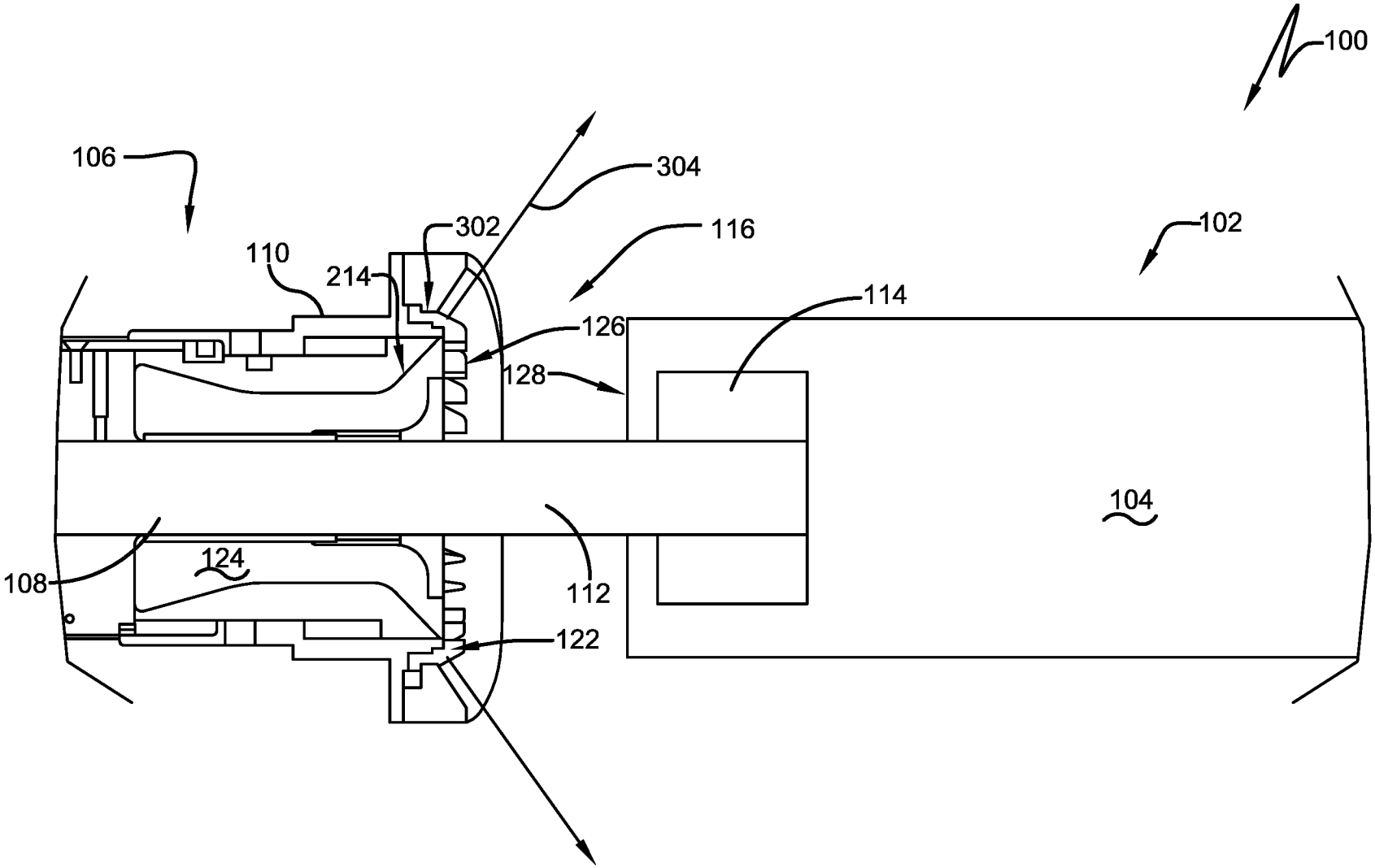
FIG. 3 is a component diagram illustrating an example implementation of one or more portions of one or more components described herein.

FIGS. 1, 2 and 3 are component diagrams illustrating an implementation of an exemplary device 100 (e.g., a foam nozzle) for dispensing firefighting fluid. In this implementation, the exemplary device 100 comprises a nozzle 106. The nozzle 106 comprises a nozzle body 212 and a nozzle inlet 118. The nozzle inlet 118 is configured to receive a flow of fluid into the nozzle 106. In this implementation, the exemplary device 100 can comprise a nozzle stem 108 that is centrally disposed in the nozzle 106, and is fixedly engaged with the nozzle body 212. That is, for example, the nozzle stem 108 can be centrally in a nozzle fluid passage 124, which comprises an interior portion of the nozzle body 212. In this example, this type of arrangement can allow the fluid to flow around the nozzle stem 108 from the nozzle inlet 118 to a nozzle outlet 126.

In one implementation, the nozzle stem 108 can be fixedly coupled with the nozzle body 212 utilizing connector vanes (not shown). The connector vanes can be fixedly engaged with an interior wall of the nozzle fluid passage 124 at a first end, and fixedly engaged with the nozzle stem 108 at an opposite end. In this way, the nozzle stem 108 can be disposed centrally in the nozzle passage 124. Further, in one implementation, the one or more nozzle vanes can comprise thin planar strips aligned along the direction of fluid flow. In this way, for example, the vanes may impart less drag and/or turbulence on the fluid during operation.

The nozzle stem 108 can be engaged with a baffle disposed at a distal end of the fluid passage 124. As an example, the baffle can be configured to direct the flow of fluid to perimeter portion of the fluid passage 124, toward the pattern sleeve 110, in an annular pattern. In another implementation, the baffle may be configured to modulate a flow rate, and/or flow pressure, in the nozzle. In this implementation, the baffle may be movable linearly in the nozzle body (e.g., or the discharge tube may be movable with respect to a stationary baffle). As illustrated in FIG. 2, when the pattern sleeve is disposed in the extended position 202, the flow of fluid is directed into a straight stream pattern 204. In this configuration, the pattern sleeve is extended past a discharge tube 214 portion of the nozzle, resulting in the extended position 202 of the pattern sleeve 110 providing a straight passage to the outlet end 126 of the nozzle. In one implementation, the discharge tube 214 portion may be formed by the nozzle body 212; and in another configuration, the discharge tube 214 may comprise a separate component from the nozzle body 212.

As illustrated in FIG. 3, when the pattern sleeve is disposed in the retracted position 302, the flow of fluid is directed into a divergent, dispersed pattern 304 (e.g., fog or cone-shaped pattern). In this configuration, the distal end of the pattern sleeve 110 is disposed in alignment with (e.g., or proximally to) the distal end of the discharge tube 214 portion, providing a divergent passage to the outlet end 126 of the nozzle. In this implementation, the resulting discharged fluid can present the dispersed pattern 304.

In one implementation, the exemplary device 100 can comprise a foam tube 102 that is configured to receive and dispense at least a portion of the flow of fluid from the nozzle 106. Further, the exemplary foam nozzle 100 can comprise a foam tube coupler 112 (e.g., connector) that is fixedly engaged with the foam tube 102. In this implementation, the foam tube coupler 112 can be configured to operably couple with the nozzle stem 108. In one implementation, the foam tube coupler 112 can be configured to be selectably, operably coupled with the nozzle stem 108. For example, the nozzle stem 108 and foam tube coupler 112 may comprise a threaded coupling arrangement, such as female thread on the nozzle stem 108 and a male thread on the foam tube coupler 112 (e.g., or vice versa). As another example, the coupling between the nozzle stem 108 and the foam tube coupler 112 can comprise other coupling systems, such as a quick connect, a quarter turn connector, or others that provide for a fixed coupling between the two components.

In this implementation, the centrally disposed nozzle stem 108, when coupled with a centrally disposed foam tube coupler 112 (e.g., connector), can provide for substantially unimpeded straight stream 204 flow of fluid from the nozzle outlet 126 to the foam tube inlet 128. As described above, in one implementation, the configuration of the nozzle 106 can provide for an annular discharge of fluid from the nozzle outlet 126. For example, the fluid flow is directed along the nozzle body 212 to the baffle, which directs the flow of fluid to the discharge tube 214 portion. In this example, when the pattern sleeve 110 is disposed in the extended position 202, the flow of fluid is discharged in a straight stream 128, in an annular pattern. Further, because the nozzle stem 108 and foam tube coupler 112 are disposed centrally, the straight stream 128 flow is directed to the foam tube 102, substantially unimpeded by the engaged nozzle stem 108 and foam tube coupler 112.

Further, in this implementation, the centrally disposed nozzle stem 108, when coupled with a centrally disposed foam tube coupler 112, can provide for substantially unimpeded dispersed stream 304 flow of fluid from the nozzle outlet 126. In one implementation, the exemplary device 100 can comprise a tip gap 116 defined by the nozzle outlet 126 at a proximal end and the foam tube inlet 128 at a distal end, and open at the sides. In this implementation, as illustrated in FIG. 3, the divergent stream, provided when the pattern sleeve 110 is disposed in the retracted position 302, as described above, may discharge through the open sides of the tip gap 116. Existing foam tube coupling systems utilized coupling elements around the perimeter of the foam tube, between a nozzle outlet and a foam tube inlet. For example, because the coupled nozzle stem 108 and foam tube coupler 112 provide a centrally disposed coupling, the dispersed stream 304 may be discharged at the tip gap 116 with little impediment.

In this way, for example, a dispersed or fog pattern stream need not be patterned at the distal end of the foam tube, as is undertaken by existing foam tubes systems. For example, existing foam tube systems typically utilize a set of jaws at the distal end of the foam tube to pattern the stream into a dispersed, flat or flog like pattern. These jaws tend to add extra weight to the end of the system, which can make operation unwieldly, and add to equipment failure, and cost. Without the pattern jaws, for example, the weight of the system is balanced back toward the operator, which allows for ease of use, can mitigate fatigue and stress to the system.

In one implementation, as illustrated in FIG. 2, the straight stream 204 of fluid discharged from the nozzle outlet 126 can comprise a first diameter (e.g., diameter of the annular shaped fluid discharge). Further, in this implementation, the foam tube inlet can comprise a second diameter, where the second diameter is larger than the first diameter. That is, for example, the straight stream 204 of fluid can be configured with a diameter that allows it to fit through the foam tube inlet 128. In this way, for example, a substantial portion of the straight stream 204 can effectively be transferred between the nozzle 106 and the foam tube 102.

In one aspect, a difference between the first diameter of straight stream 204 and the second diameter of the tube inlet 128 can define an annular air gap 216 between the straight stream 204 and the perimeter of the tube inlet 128. In one implementation, in this aspect, the air gap 216 can be configured (e.g., sized and/or shaped) to provide for air flow 206 uptake into the foam tube 102 during operation. That is, for example, the straight stream 204 flow of fluid from the nozzle 106 to the foam tube 102 can create a fluid flow that draws air 206 into the tip gap 116, and into the air gap 216 between the straight stream 204 and the perimeter of the tube inlet 128. In this implementation, the air 206 drawn into the foam tube 102 can be entrained into the foam/water mixture in the straight stream 204, for example, resulting in a desired foam/water/air mixture discharge at the tube outlet 120.

In this aspect, in one implementation, the air gap 216 can be configured to provide a desired amount of air entrainment into the foam-water mixture to provide a desired foam-water-air mixture at discharge. That is, for example, a size, shape, flow rate, and/or flow pressure of the straight stream 204 can be adjusted according to a desired use or purpose. Further, the size of the foam tube inlet 128 can be configured to provide a desired air gap 216 that results in the desired foam mixture discharge. That is, for example, differently sized first diameters and second diameters can result in different amounts and qualities of the entrainment and mixture of air into the foam mixture. Sound engineering judgement can be used to identify the desired air flow 206 for a desired purpose and/or result.

In another aspect, as illustrated in FIG. 3, substantial portions of the dispersed stream 304 of fluid is configured to bypass the foam tube 102. In this aspect, for example, the air gap 216 formed in the foam tube may not be able to provide air entrainment to the dispersed stream 304. In one implementation, in this aspect, a turbine component 122 can be disposed at the distal end of the nozzle 106, proximate the nozzle outlet 126. In this implementation, the turbine component 122 can be disposed in the path of the dispersed stream 304.

As an example, the turbine component 122 can comprise vanes (e.g., teeth) that are configured to impart spin on the turbine component 122 when subjected to fluid flow. In this way, for example, the flow of the dispersed stream 304 across the turbine vanes can result in the turbine component spinning, which can provide for air entrainment into the dispersed stream 304 of fluid. That is, for example, the spinning turbine component can draw air into the foam-water mixture, resulting in a foam-water-air fluid mixture being discharged in the dispersed stream 304, which substantially bypasses the foam tube 102.

As illustrated in FIGS. 1-3, in one aspect, the pattern sleeve 110 can be configured to linearly translate along the nozzle body 212 between the first position 202 (e.g., extended position) and the second position 302 (e.g., retracted position). In one implementation, in this aspect, the pattern sleeve 110 can be slidably engaged with the nozzle body 212, such that the pattern sleeve 110 may slide between the first position 202 and the second position 302 (e.g., slid by a user and/or an actuator). In one implementation, the pattern sleeve 110 can be slidably and/or rotatably engaged with the nozzle body 212. That is, for example, applying a rotation force to the pattern sleeve 110 may result in a linear translation of the pattern sleeve 110 along the nozzle body 212 between the first position 202 and the second position 302. In this implementation, for example, the nozzle can comprise a cam and thread system that is configured to translate rotational motion into linear motion. In this way, for example, a user (e.g., manually or utilizing a remote or automated actuator) can adjust between a straight stream foam discharge, and a dispersed (e.g., fog or conically shaped) pattern merely by rotating the pattern sleeve around the nozzle body (e.g., utilizing a bumper engaged with the pattern sleeve).

Figure 4A:
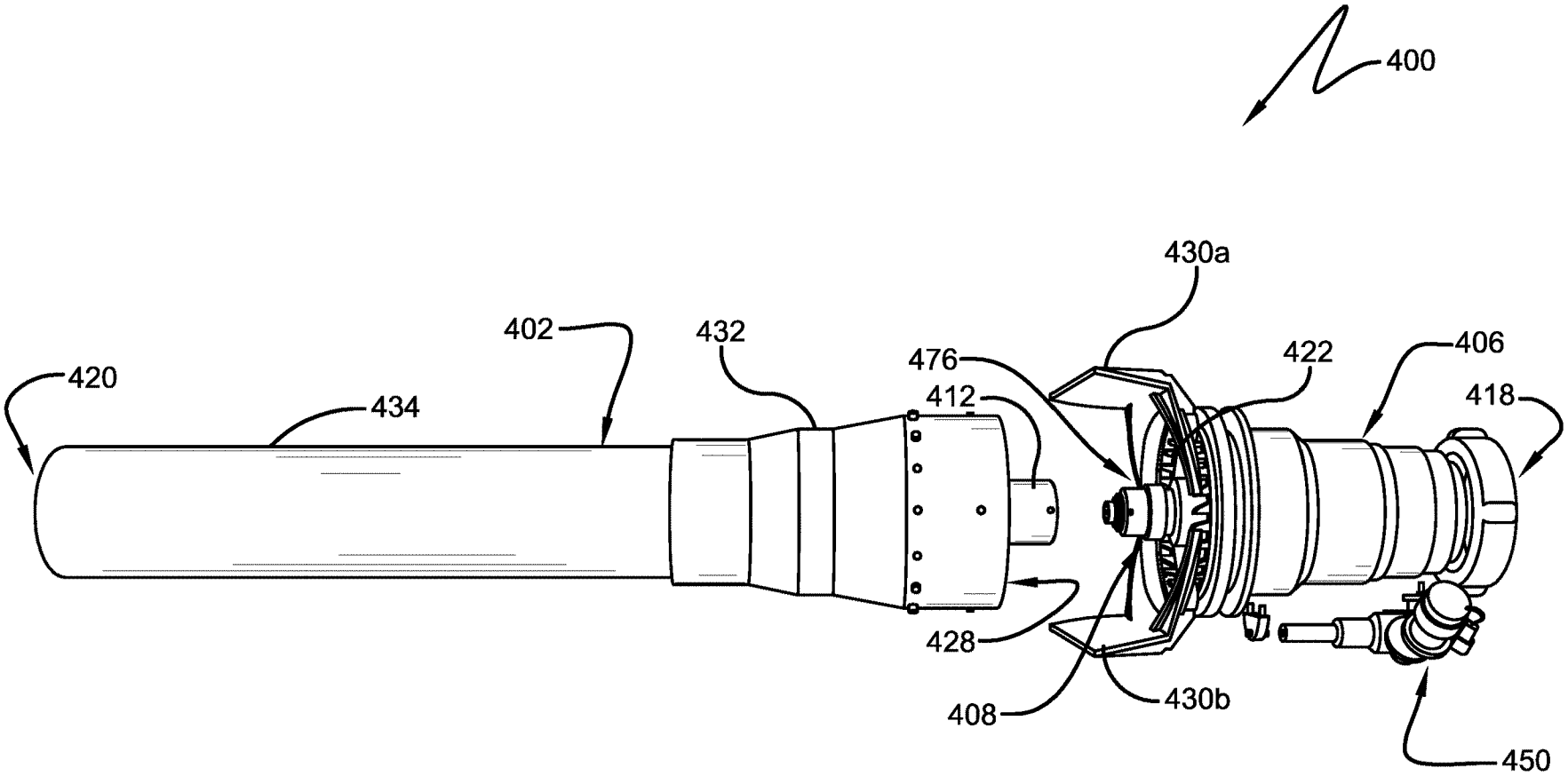
FIGS. 4A and 4B are component diagrams illustrating example implementations of one or more portions of one or more components described herein.
Figure 4B:
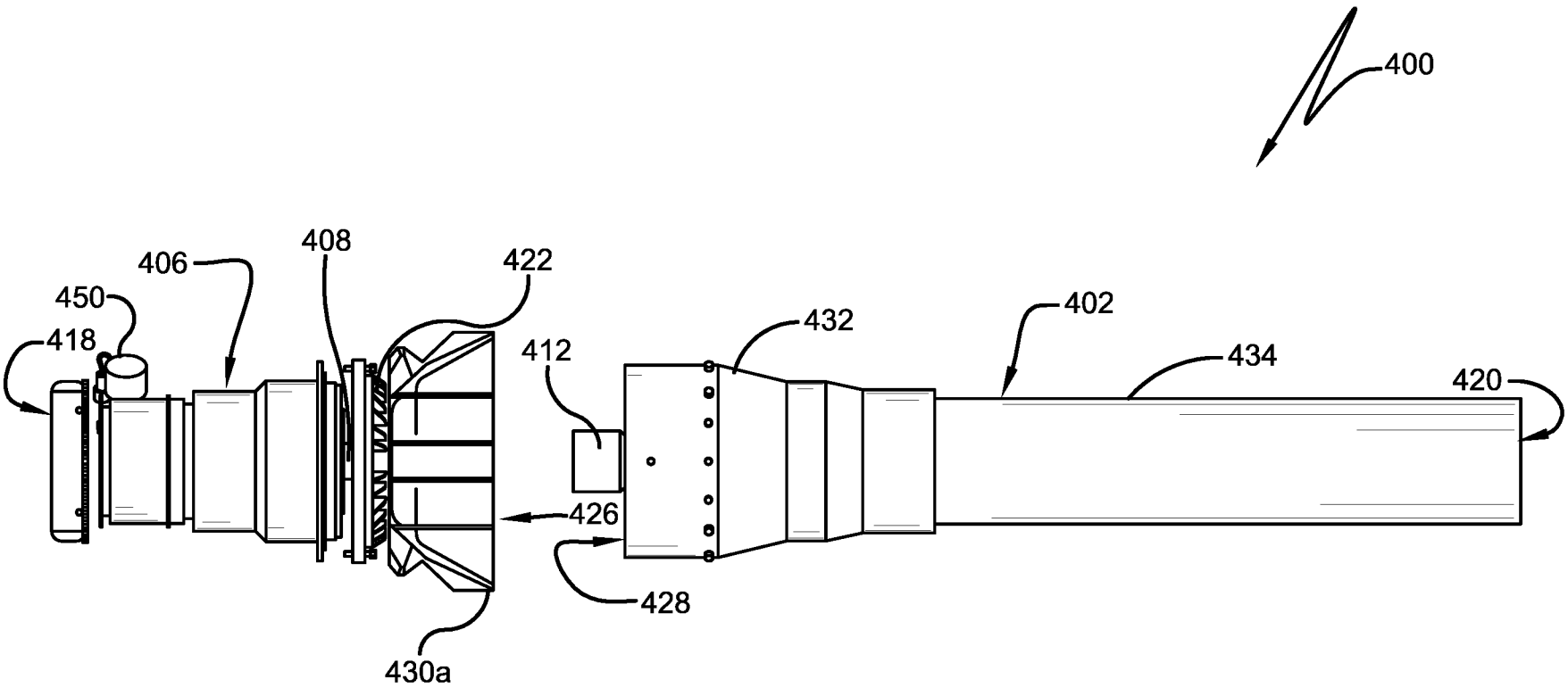
Figure 5:
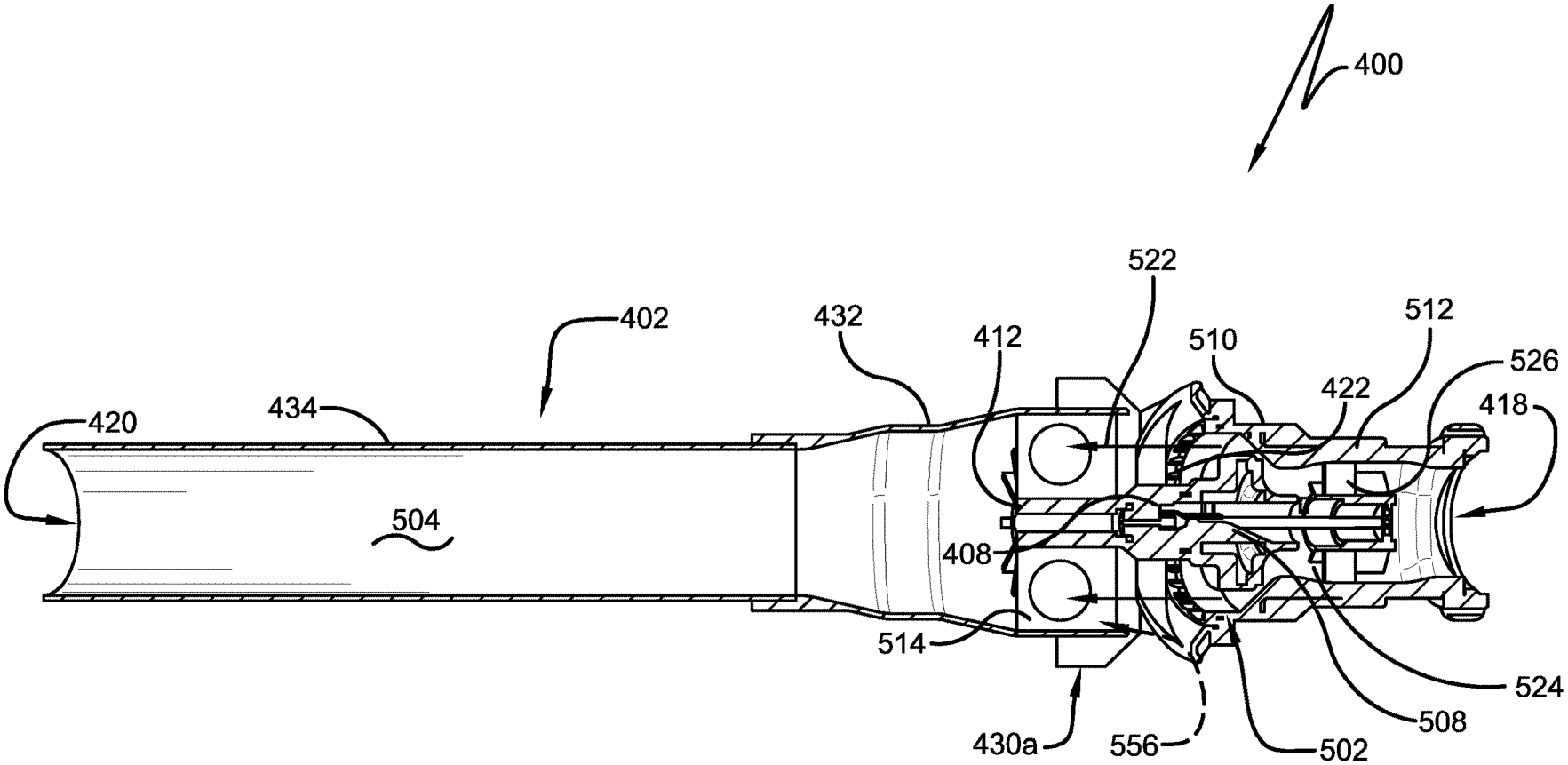
FIG. 5 is a component diagram illustrating a side cut-away view of an example implementation of one or more portions of one or more components described herein.

FIGS. 4A, 4B, 5, 6, 7, and 8 are component diagrams illustrating an alternate implementation of an exemplary fluid dispensing system 400, such as a foam nozzle system. In one implementation, as illustrated in FIGS. 4A and 4B, the exemplary system 400 can comprise a separate foam tube 402 and nozzle 406. In this implementation, the foam tube 402 can comprise a first portion 432 and a second portion 434. As illustrated in FIG. 5, the first portion 432 may comprise a converging tube in a downstream direction, and the second portion 434 can comprise a substantially uniform tube in the downstream direction. As an example, in this implementation, the converging passage portion of the foam tube chamber 504 may force the foam-water mixture into contact with the introduced air flow, helping entrainment of the air into the mixture, resulting in a desired mixture of the foam-water-air.

Figure 6:
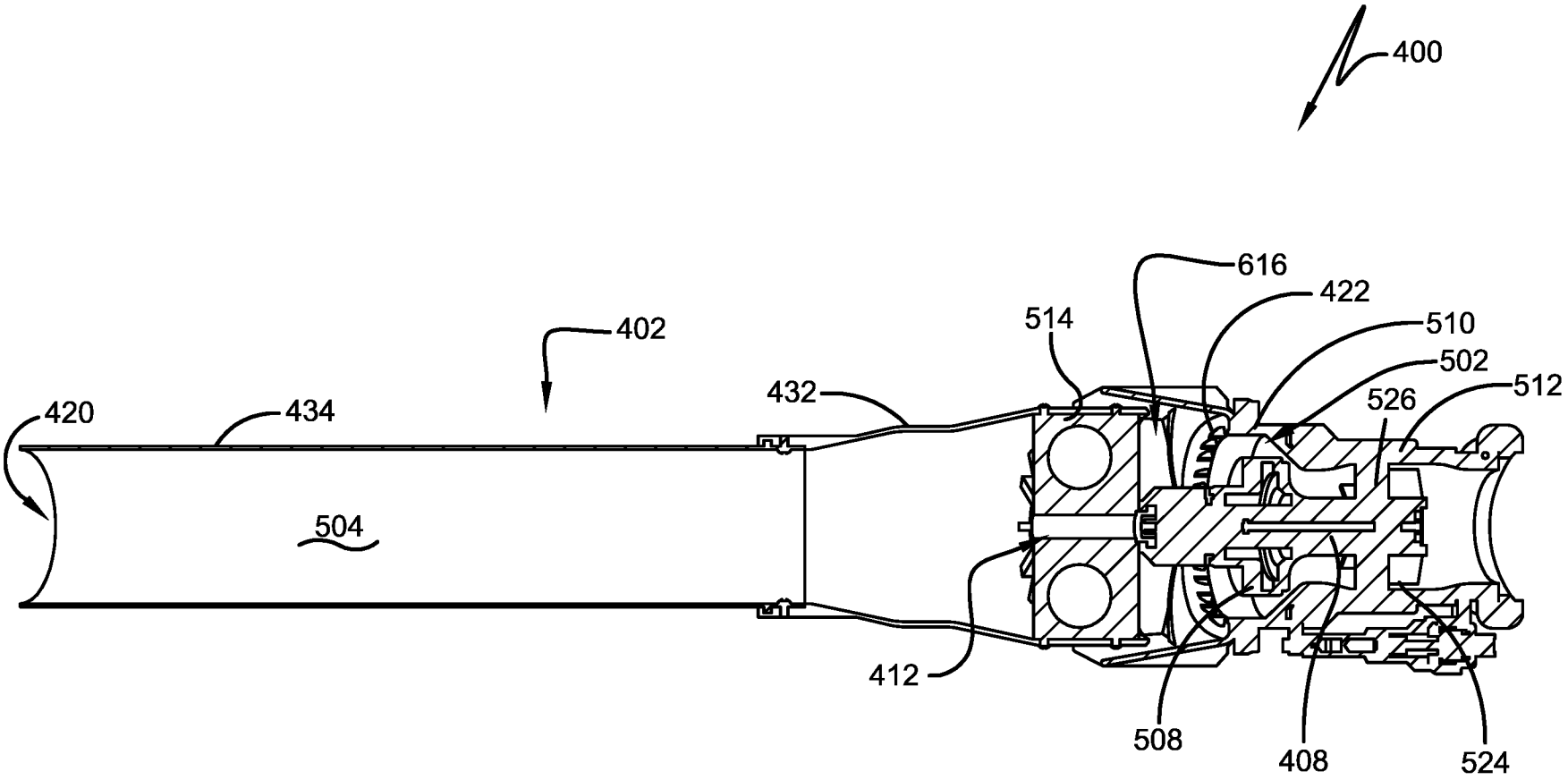
FIG. 6 is a component diagram illustrating a top cut-away view of an example implementation of one or more portions of one or more components described herein.
Figure 7:
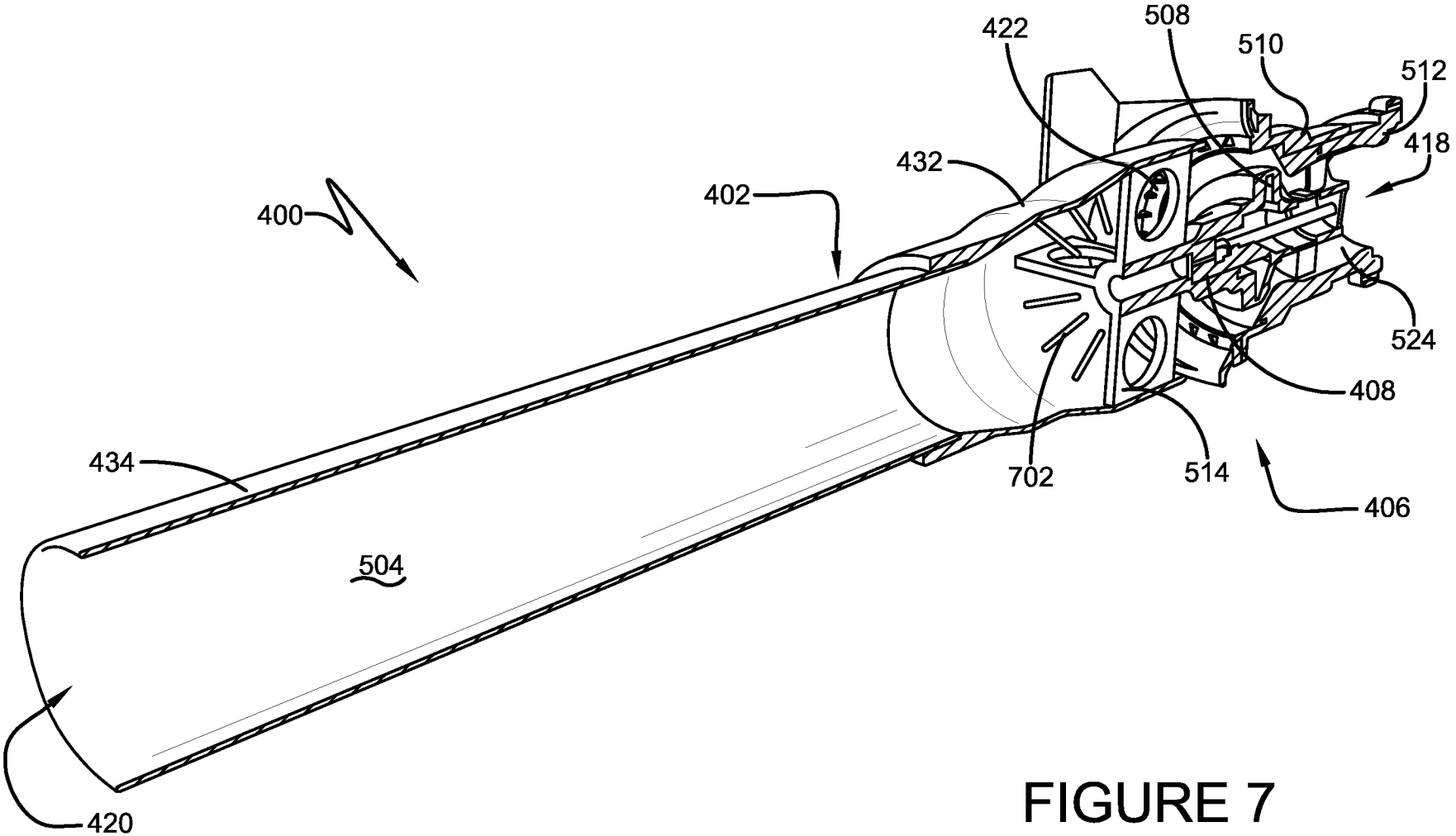
FIG. 7 is a component diagram illustrating a front-side perspective cut-away view of an example implementation of one or more portions of one or more components described herein.
Figure 8:
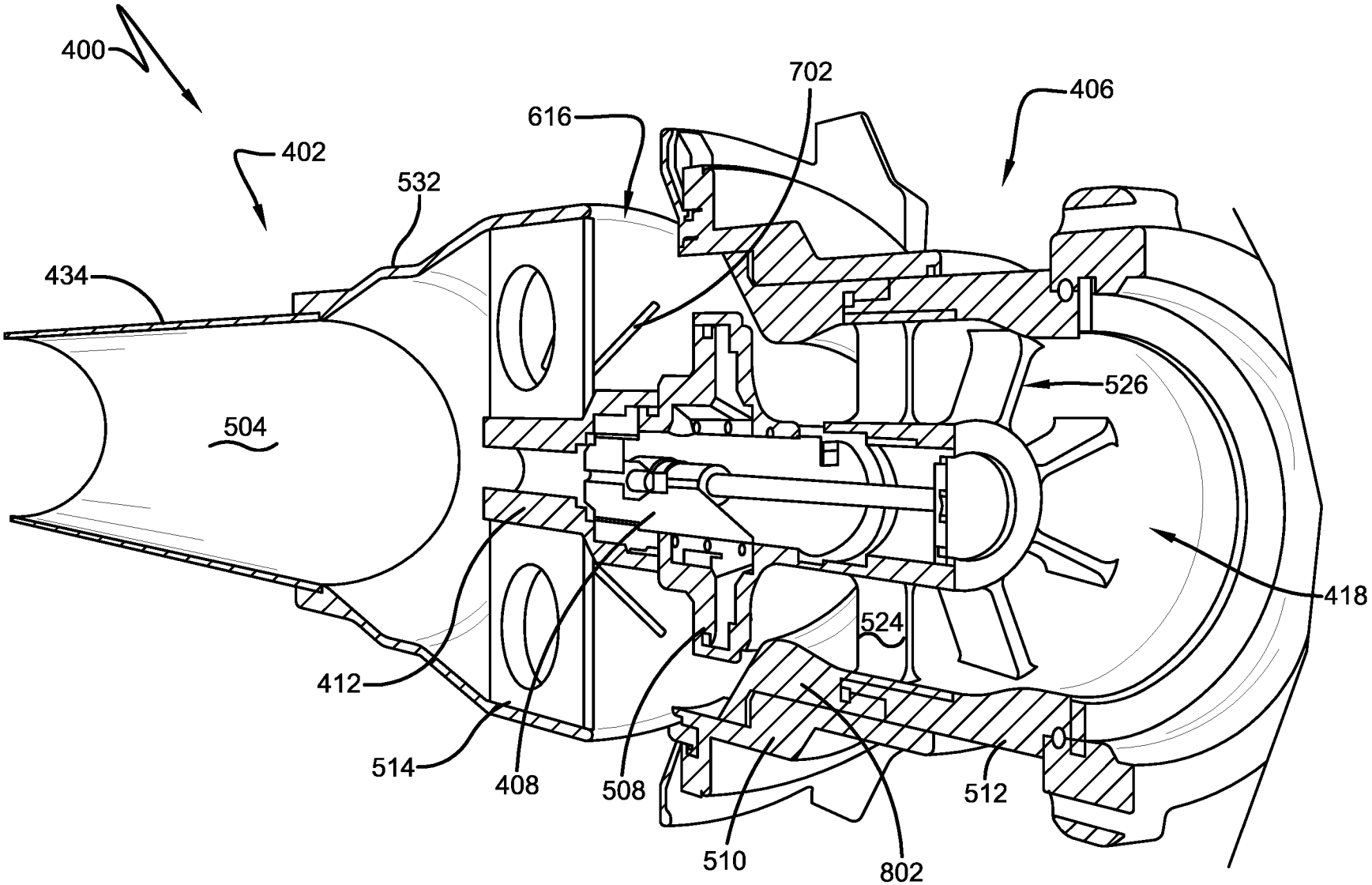
FIG. 8 is a component diagram illustrating a rear-side perspective cut-away view of an example implementation of one or more portions of one or more components described herein.

Additionally, in one implementation, as illustrated in FIGS. 7 and 8, one or more mixers 702 may be disposed at the proximal end of the first portion 432 of the foam tube 402, inside the foam chamber 504. In this implementation, the mixers 702 can be fixedly engaged with the foam tube 402, and/or with a tube coupler 412 disposed in the foam tube 402. As illustrated in FIG. 6, the one or more mixers can be disposed in the path of the straight stream 552 received from the nozzle 406, and configured to facilitate mixing of the air flow 556 into the foam-water mixture; resulting in a desired foam mixture discharging from the foam tube 402.

Returning the FIGS. 4A and 4B, the foam tube 402 of the exemplary system 400 can comprise a tube inlet 428 and a tube outlet 420. Further, the nozzle 406 can comprise a nozzle inlet 418 and a nozzle outlet 426. Additionally, in some implementations, the nozzle 406 can comprise a self-educting nozzle. That is, for example, the nozzle 406 may comprise a foam solution inlet that is configured to introduce a foam solution into nozzle 406, where it is mixed with water, introduced to the nozzle through the inlet 428. As an example, a supply of a foam solution, such as foam concentrate, can supplied to the foam inlet, and a pressurized fluid, such as water, can be supplied to the inlet 428. A portion of pressurized water can enter an eductor chamber potion of the nozzle, where the pressurized water can create a reduction in fluid pressure, creating a vacuum in the eduction chamber, resulting in the foam solution being drawn into the eduction chamber through foam inlet. The foam solution mixes with the pressurized water jets in the eduction chamber to form a foam mixture, which can be dispensed from eduction chamber be the pressure of water.

In one implementation, a self-educting foam nozzle can comprise air intake ports that provide for introduction of air into the foam mixture. As an example, the pressure of the water, and/or the foam mixture through the nozzle may provide for a vacuum that draws air into the nozzle at desired air inlets. In this example, the air can be entrained into the foam mixture to create a foam-air-water mixture, which may be discharged from the nozzle outlet 420. In one implementation, the foam-air-water mixture can be directed in a straight stream pattern, and/or a dispersed pattern.

In one implementation, the one or more stream shapers 430*a*, 430*b* can be operably coupled to the distal end of the nozzle 406. In this implementation, the one or more stream shapers 430*a*, 430*b* can be configured to direct a dispersed stream of fluid into a desired pattern shape. That is, for example, as described above, the dispersed stream can provide a wide fog-like or conically shaped pattern. In this implementation, utilizing the pattern shapers 430*a*, 430*b*, the dispersed pattern can be directed into a desired shape, such as a flat or spread pattern, while still bypassing the foam tube 402. It should be noted that a variety of pattern shapers are anticipated, and may be designed to create a desired foam discharge pattern that is useful for a specific situation during operation.

FIGS. 5, 6, 7, and 8 are component diagrams illustrating cut-away views of the alternate exemplary fluid dispensing system 400. FIG. 5 is a side view, FIG. 6 is a top view, and FIGS. 7 and 8 are perspective front and rear views, respectively. As illustrated, the foam tube 402 can comprise a foam chamber, disposed in the first portion 432 and second portion 434 respectively. As described above, the first portion 432 of the foam chamber 504 comprises a converging passage, and the second portion 434 of the foam chamber 504 comprises a relatively uniform passage leading to the tube outlet 420.

A tube coupler 412 (e.g., nozzle connector) is disposed centrally at the proximal end of the foam chamber 504. The tube coupler 412 can be fixedly engaged in central disposition utilizing one or more tube vanes 514. In one implementation, the tube vanes 514 can be fixedly engaged with a wall of the foam chamber 504 at a first end, and fixedly engaged with the tube coupler 412 at a second end. Further, the tube vanes 514 can be configured to provide a small profile to the flow of fluid through the chamber 504. That is, as illustrated, the vanes 514 can comprise thin, flat, planar members that are disposed longitudinally in a direction of the flow of fluid. Additionally, in one implementation, the one or more vanes 514 can comprise vias disposed through at least a portion of respective vanes 514. For example, the vias may provide for additional mixing or agitation of the fluid-air mixture, and may be able to mitigate pressure differentials between either side of a vane 514.

The tube coupler 412 can be configured to operably engage (e.g., selectably) with a nozzle stem 408 that is fixedly coupled with a nozzle body 512. As described above, the nozzle stem 408 can be centrally disposed in the nozzle body 512, for example, by utilizing nozzle vanes 526 coupled to the nozzle body 512 and the nozzle stem 408. Further, the nozzle stem can be operably coupled with a baffle 508, which may be used to direct the flow of fluid to a pattern sleeve 510 (e.g., and/or may be used to adjust a flow rate or pressure of fluid). As illustrated in the FIGS. 5-8, the pattern sleeve can be disposed in a first position 502 (e.g., extended position), which allows for the flow of fluid to be directed into a straight stream 552. Alternatively, if the pattern sleeve 510 is disposed in a second position (not illustrated) (e.g., a retracted position), the flow of fluid may be directed to a dispersed pattern (not shown), for example. In this example, the one or more pattern shapers 430*a* can direct the dispersed stream into a desired shape, such as a flat or spread pattern.

As illustrated in FIGS. 4-8, in one implementation, the nozzle can comprise a turbine component 422, disposed proximate the nozzle outlet 426. As described above, the turbine component 422 can comprise a series of turbine vanes (e.g., turbine teeth). As an example, the turbine vane portion of the turbine component can be disposed in the path of the dispersed stream. In this example, the turbine vanes can be configured to provide a rotating force to the turbine component when impacted by the dispersed stream (e.g., angled vanes). In this way, for example, the dispersed stream impacting the turbine component 422 may result in rotation of the turbine component 422, which provides for air to be entrained in the dispersed stream. The air entrained in the dispersed stream, comprising a foam solution, can result in a desired foam mixture delivered in the desired spread pattern, for example.

In another implementation, the example device 400 may utilize a nozzle without the turbine component 422; or, may utilize a turbine-like component that is stationary. That is, for example, a desired foam mixture for a particular operation may be provided to (e.g., or by) the nozzle 406, which is sufficient for operation, such as in the dispersed pattern mode. As another example, a self-educting nozzle may provide a sufficient foam-air-water mixture for use in a particular operation. That is, for example, as described above, a self-educting nozzle can may be able to generate the appropriate foam mixture using an eduction chamber and air ports. In this example, a turbine component 422 may not be utilized, and/or the turbine teeth or vanes may provide rotation of the turbine component 422.

As illustrated in FIGS. 5-8, the exemplary system 400 comprises the nozzle body 512, which can define a nozzle fluid passage 524. In this implementation, the nozzle fluid passage 524 fluidly couples the nozzle inlet 418 with the nozzle outlet 426. In one implementation, the pattern sleeve 510 is slidably engaged with the nozzle body 512, such that the pattern sleeve 510 can be linearly translated between the first position 502 and the second position (not shown), such as by a user and/or by an actuator. In another implementation, as described above, the pattern sleeve 510 can be configured to rotate around the nozzle body 512, where the rotational motion is translated into linear translation (e.g., between the extended and retracted positions). For example, in one implementation, a user may linearly slide the pattern sleeve 510 between the first position 502 and the second position; or the user may use a rotation action to translate the pattern sleeve 510 between the first position 502 and second position. In another implementation, an actuator (e.g., remotely or locally controlled) may be used to linearly or rotationally translate the pattern sleeve 510 between the first position 502 and the second position. As an illustrative example, in FIGS. 4A and 4B, a pattern actuator 450 can be coupled with the nozzle 406 and used to actuate either the linear or rotational of the pattern sleeve.

As illustrated in FIG. 8, in one implementation, the nozzle body 512 may be operably coupled with a discharge tube 802. For example, the discharge tube can comprise a separate component disposed at the distal end of the fluid passage 524, and is configured to direct the flow of fluid in a desired flow. In another implementation, the discharge tube (e.g., 802) can be formed with, or be a part of, the nozzle body 512. As an illustrative example, the discharge tube 802 can be shaped to provide a desired fluid discharge pattern, flow rate, flow pressure, etc., when combined with the baffle 508 and/or the pattern sleeve 510. That is, for example, the discharge tube 802 may fixedly attached to, be part of, or separate from, the nozzle body 512; and can be configured to direct the flow of fluid at the nozzle outlet 426.

Figure 9:
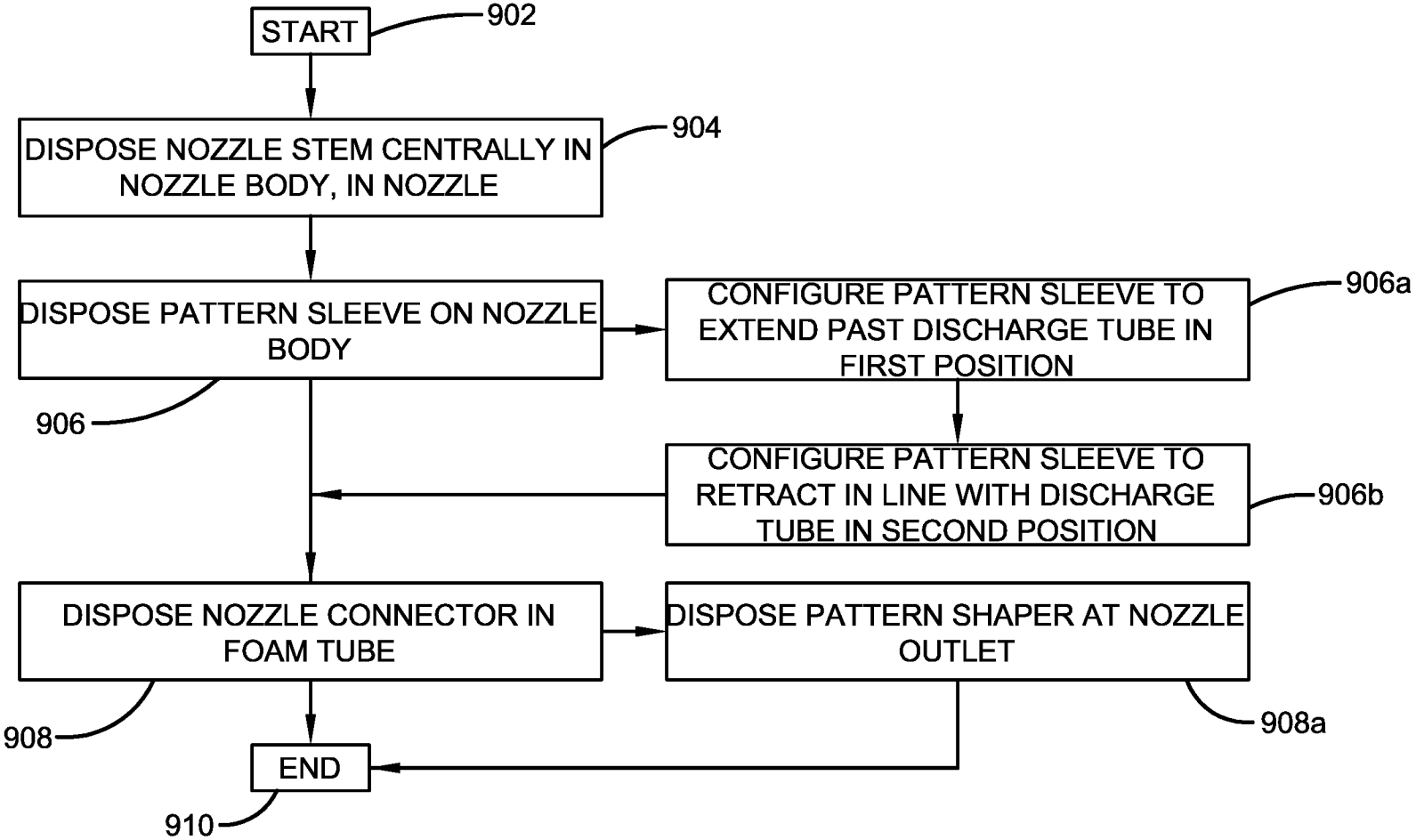
FIG. 9 is a flow diagram illustrating and exemplary method for manufacturing a device for dispensing fluid.

In one aspect, a method of manufacture can be devised for manufacturing a device for dispensing firefighting fluid, such as one or more portions of one or more systems described herein. FIG. 9 is a flow diagram illustrating an example method 900 for manufacturing a device for dispensing firefighting fluid. In this implementation, the exemplary method of manufacture 900 begins at 902. At 904, a nozzle stem can be fixedly engaged in a central disposition in a nozzle body. The nozzle body can be disposed in a nozzle, where the nozzle comprises a nozzle body, an outlet, and an inlet that configured to receive a flow of fluid.

At 906, a pattern sleeve can be disposed on the nozzle body. In this implementation, the pattern sleeve can be configured to translate linearly along the nozzle body between a first position and a second position. Further, the pattern sleeve can be configured to direct the fluid in a substantially straight pattern at the outlet end, in the first position. Additionally, the pattern sleeve can be configured to direct the dispensed fluid in a substantially dispersed pattern at the outlet end, in the second position.

At 908, a nozzle connector can be fixedly disposed centrally in a foam tube. The foam tube can be configured to receive the straight stream flow of fluid from the nozzle; and the nozzle connector can be configured to operably couple with the nozzle stem. In one implementation, at 906*a*, at least a portion of the pattern sleeve can be configured to extend past a discharge tube portion of the nozzle at the outlet in the first position. Further, at 906*b*, at least a portion of the pattern sleeve can be configured to retract in line with the discharge tube portion of the nozzle at the outlet in the second position, which can result in the flow of fluid to substantially bypass the foam tube. In another implementation, at 908*a*, a pattern shaper can be disposed at the outlet end of the nozzle, where the pattern shaper configured to shape the dispersed pattern of the flow of fluid.

Having fixedly disposing the nozzle connector centrally in a foam tube, the example method 900 ends at 910.

The word "exemplary" is used herein to mean serving as an example, instance or illustration. Any aspect or design described herein as "exemplary" is not necessarily to be construed as advantageous over other aspects or designs. Rather, use of the word exemplary is intended to present concepts in a concrete fashion. As used in this application, the term "or" is intended to mean an inclusive "or" rather than an exclusive "or." That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. Further, at least one of A and B and/or the like generally means A or B or both A and B. In addition, the articles "a" and "an" as used in this application and the appended claims may generally be construed to mean "one or more" unless specified otherwise or clear from context to be directed to a singular form.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims. Reference throughout this specification to "one embodiment" or "an embodiment" means that a particular feature, structure, or characteristic described in connection with the embodiment is included in at least one embodiment. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments. Of course, those skilled in the art will recognize many modifications may be made to this configuration without departing from the scope or spirit of the claimed subject matter.

Also, although the disclosure has been shown and described with respect to one or more implementations, equivalent alterations and modifications will occur to others skilled in the art based upon a reading and understanding of this specification and the annexed drawings. The disclosure includes all such modifications and alterations and is limited only by the scope of the following claims. In particular regard to the various functions performed by the above described components (e.g., elements, resources, etc.), the terms used to describe such components are intended to correspond, unless otherwise indicated, to any component which performs the specified function of the described component (e.g., that is functionally equivalent), even though not structurally equivalent to the disclosed structure which performs the function in the herein illustrated exemplary implementations of the disclosure.

In addition, while a particular feature of the disclosure may have been disclosed with respect to only one of several implementations, such feature may be combined with one or more other features of the other implementations as may be desired and advantageous for any given or particular application. Furthermore, to the extent that the terms "includes," "having," "has," "with," or variants thereof are used in either the detailed description or the claims, such terms are intended to be inclusive in a manner similar to the term "comprising."

What is claimed is:

1. A device for dispensing firefighting fluid, comprising:

a nozzle comprising a nozzle body, an inlet configured to receive a flow of fluid, and an outlet to dispense the fluid from the nozzle;

a nozzle stem centrally disposed in the nozzle and fixedly engaged with the nozzle body;

a foam tube attachment configured to receive and dispense at least a portion of the flow of fluid from the outlet of the nozzle the foam tube attachment comprising a foam tube coupler configured to selectably, operably couple the foam tube attachment with the nozzle stem, wherein an air gap is formed between the nozzle outlet and the foam tube attachment when the foam tube coupler is coupled with the nozzle stem; and a pattern sleeve operably coupled with the nozzle body and linearly translating between a first position and a second position, the first position comprising an extended position providing a substantially straight stream flow of fluid from the outlet of the nozzle to the foam tube attachment, wherein air is drawn into the foam tube attachment through the air gap, the second position comprising a retracted position that provides a dispersed flow of fluid from the nozzle outlet that passes through the air gap, substantially bypassing the foam tube attachment.

2. The device of claim 1, the straight stream of fluid comprising a first diameter and an inlet to the foam tube attachment comprising a second diameter, the first diameter configured to be less than the second diameter resulting in the air gap between the straight stream of fluid and the inlet to the foam tube attachment drawing air into the foam tube attachment during operation.

3. The device of claim 1, comprising a turbine component disposed in a path of the dispersed flow of fluid, the turbine component configured to entrain air into the dispersed flow of fluid during operation.

4. The device of claim 1, the pattern sleeve configured to rotate around the nozzle body, the rotation resulting in the linear translation between the first position and the second position.

5. A system for dispensing firefighting fluid, comprising:

a nozzle configured to dispense the fluid at an outlet end, comprising:

a pattern sleeve configured to:

direct the fluid in a substantially straight pattern at the outlet end, in a first position; and direct the fluid in a substantially dispersed pattern at the outlet end, in a second position, the dispersed pattern configured to allow the fluid to substantially bypass an inlet to a foam tube attachment; and the foam tube attachment comprising the inlet, an outlet, and a nozzle connector configured to operably couple the foam tube attachment with the nozzle, the nozzle connector providing an air gap between a nozzle outlet and the foam tube attachment inlet, the foam tube attachment configured to:

receive the straight pattern of the fluid at the inlet;

receive air at the inlet; and dispense a fluid/air mixture at the outlet;

wherein the straight pattern of fluid passes from the nozzle outlet to the foam tube inlet and air is drawn into the foam tube through the air gap when the nozzle is disposed in the first position, and the dispersed pattern of fluid passes through the air gap and bypasses the foam tube attachment in the second position.

6. The system of claim 5, the nozzle comprising a nozzle body, and the pattern sleeve configured to linearly translate along the nozzle body between the first position and the second position.

7. The system of claim 6, the first position comprising an extended position of the pattern sleeve, and the second position comprising a retracted position of the pattern sleeve.

8. The system of claim 5, the nozzle connector centrally disposed in the foam tube attachment and configured to operably couple with a nozzle stem centrally disposed in the nozzle.

9. The system of claim 8, the nozzle stem centrally disposed in, and fixedly engaged with, the nozzle.

10. The system of claim 8, the nozzle connector configured to selectably, operably couple with the nozzle stem.

11. The system of claim 5, the foam tube attachment comprising one or more vanes engaged with the interior of the foam tube attachment and the nozzle connector, and configured to hold the nozzle connector in a centrally disposed position in the foam tube attachment.

12. The system of claim 5, the nozzle comprising a dispersed pattern shaper disposed at the outlet of the nozzle and configured to shape the dispersed pattern flow of fluid.

* * * * *